US009155433B2

(12) United States Patent
Wofford et al.

(10) Patent No.: US 9,155,433 B2
(45) Date of Patent: Oct. 13, 2015

(54) FLOOR CLEANING APPARATUS WITH FILTER DRAWER

(71) Applicant: Panasonic Corporation of North America, Secaucus, NJ (US)

(72) Inventors: Joseph B. Wofford, Danville, KY (US); Eric E. Muhlenkamp, Lexington, KY (US)

(73) Assignee: PANASONIC CORPORATION OF NORTH AMERICA, Secaucus, NJ (US)

( * ) Notice: Subject to any disclaimer, the term of this patent is extended or adjusted under 35 U.S.C. 154(b) by 367 days.

(21) Appl. No.: 13/686,321

(22) Filed: Nov. 27, 2012

(65) Prior Publication Data

US 2014/0143977 A1 May 29, 2014

(51) Int. Cl.
*A47L 9/10* (2006.01)
*A47L 9/12* (2006.01)

(52) U.S. Cl.
CPC ..... *A47L 9/122* (2013.01); *Y10T 29/49826* (2015.01)

(58) Field of Classification Search
CPC ..... A47L 9/122; Y10T 29/49826
USPC ..... 15/347, 352, 327.2
IPC ..... A47L 9/10
See application file for complete search history.

(56) References Cited

U.S. PATENT DOCUMENTS

| | | | |
|---|---|---|---|
| 4,670,937 | A | 6/1987 | Sumeru et al. |
| 4,705,547 | A | 11/1987 | Rotola, Jr. et al. |
| 5,230,722 | A | 7/1993 | Yonkers |
| 6,003,196 | A | 12/1999 | Wright et al. |
| 7,305,735 | B2 | 12/2007 | Overvaag |
| 7,472,456 | B2 | 1/2009 | Moore et al. |
| 7,608,123 | B2 | 10/2009 | Pineschi |
| 7,647,670 | B2 | 1/2010 | Dant et al. |
| 7,797,791 | B2 | 9/2010 | White |
| 2006/0123588 | A1 | 6/2006 | Kaiser |
| 2007/0209146 | A1 | 9/2007 | Mersmann et al. |
| 2010/0281647 | A1 | 11/2010 | Lee |

*Primary Examiner* — David Redding
(74) *Attorney, Agent, or Firm* — King & Schickli, PLLC

(57) ABSTRACT

A floor cleaning apparatus includes a body having a suction inlet and an exhaust outlet. A dirt collection vessel and a suction generator are both carried on the body. The suction generator moves an airstream through the suction inlet, the dirt collection vessel and the exhaust outlet. A filter drawer is carried on the body. A filter stop on the body aligns a filter in the filter drawer with an airstream port on the body as the filter drawer is moved from a fully opened toward a fully closed position.

20 Claims, 14 Drawing Sheets

FIG. 6d
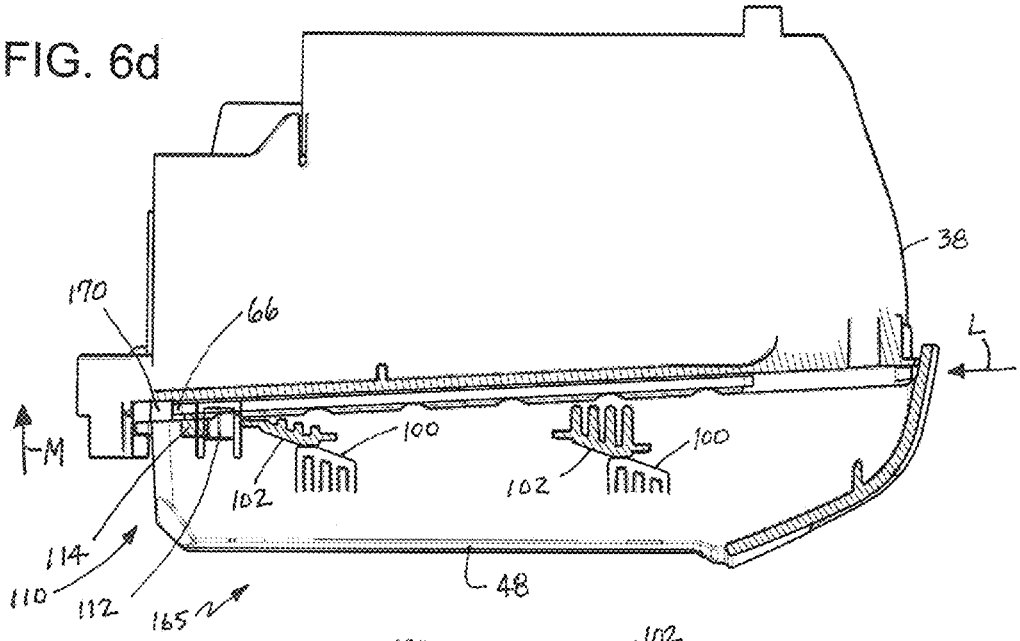
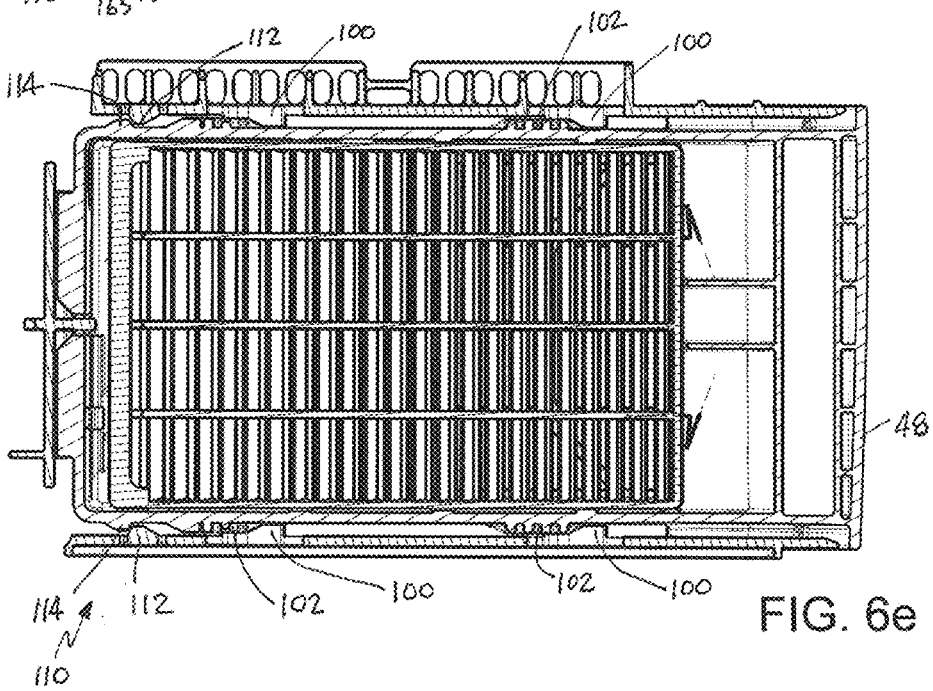
FIG. 6e

FLOOR CLEANING APPARATUS WITH FILTER DRAWER

TECHNICAL FIELD

The present invention relates generally to the floor care equipment field and, more particularly, to a floor cleaning apparatus equipped with a removable filter drawer.

BACKGROUND

Upright and canister vacuum cleaners equipped with a sliding filter drawer or tray to allow easy access for cleaning or changing a filter are well known in the art. An example of a vacuum cleaner equipped with a filter drawer may be found in U.S. Pat. No. 7,305,735 to Overwaag which is assigned to the assignee of this document.

One difficulty and concern with such a design relates to the integrity of the flow path through the filter in the drawer. In order to maximize filtering efficiency, any leaks around the filter in the drawer should be minimized or, better still, eliminated. Thus, proper sealing is a major concern. This is difficult to achieve with a sliding drawer.

This document discloses an apparatus and method for providing a filter drawer with a filter that may be easily accessed for cleaning or changing while also providing excellent sealing for greater cleaning efficiency.

SUMMARY

In accordance with the purposes of the present invention as described herein, a floor cleaning apparatus is provided comprising a body including a suction inlet and an exhaust outlet, a dirt collection vessel carried on the body and a suction generator carried on the body. The suction generator moves an airstream through the suction inlet, the dirt collection vessel and the exhaust outlet. In addition a filter drawer is carried on the body. A filter is carried in the filter drawer. An airstream port is provided on the body. A filter stop on the body aligns the filter with the airstream port as the filter drawer is moved from a fully opened position toward a fully closed position. In addition a cam arrangement is provided to positively position the filter in the sealed position when the filter drawer is fully closed. The apparatus further includes a filter biasing element that biases the filter into a home position within the filter drawer. That biasing element may take the form of a spring. In one embodiment that spring provide a biasing force of between about 3 and about 7 Newtons.

The cam arrangement comprises a first set of cams carried on the body and a cooperating second set of cams carried on the filter drawer. When the drawer is in the fully closed position, the first set of cams engages the second set of cams so as to positively displace the drawer and the filter toward the body so as to seal around the airstream port between said body and said filter.

More specifically describing the apparatus, the filter drawer moves in a travel path from the fully opened position to the fully closed position. The filter is moved into alignment with the airstream port on the body as the filter drawer is moved along a first portion of that travel path until the filter contacts the filter stop. In one embodiment, the filter includes a seal and a gap is maintained between the seal and the body as the filter drawer is moved along the first portion of the travel path. This allows for smooth and relatively easy movement of the filter drawer. The filter is then moved toward its final sealed position as the filter drawer is moved along a second portion of the travel path from a point when the filter first engages the filter stop until the filter drawer is in the fully closed position. The filter is displaced against the biasing element and moves from the home position to an operating position in the filter drawer as the filter drawer is moved along the second portion of the travel path.

In accordance with an additional aspect, a method is provided for sealing a filter in a filter drawer around an airstream port on a housing that receives the filter drawer. That method may be broadly described as comprising the steps of (a) moving the filter drawer along a travel path between a fully opened position and a fully closed position, (b) aligning the filter with the airstream port as the filter drawer is freely moved along a first portion of the travel path and (c) displacing the filter drawer and filter toward the housing until a seal engages and seals around the airstream port between the housing and the filter as the filter drawer is moved along a second portion of the travel path. The method further includes biasing the filter into a home position in the filter drawer as the filter drawer is moved along the first portion of the travel path. In addition the method includes a step of displacing the filter into an operating position in the filter drawer as the filter drawer is moved along the second portion of the filter path.

BRIEF DESCRIPTION OF THE DRAWINGS

The accompanying drawings incorporated herein and forming a part of the specification, illustrate several aspects of the vacuum cleaner and together with the description serve to explain certain principles of its construction and operation. In the drawings:

FIG. 6*d* is a view similar to FIGS. 6*a*-6*c* but illustrating the drawer in the fully closed position and the filter seal engaging and sealing against the filter seat;

FIG. 6*e* is a top plan view of the drawer in the fully closed position;

Reference will now be made in detail to the present preferred embodiment of the vacuum cleaner illustrated in the accompanying drawings.

DETAILED DESCRIPTION

Figure 1:
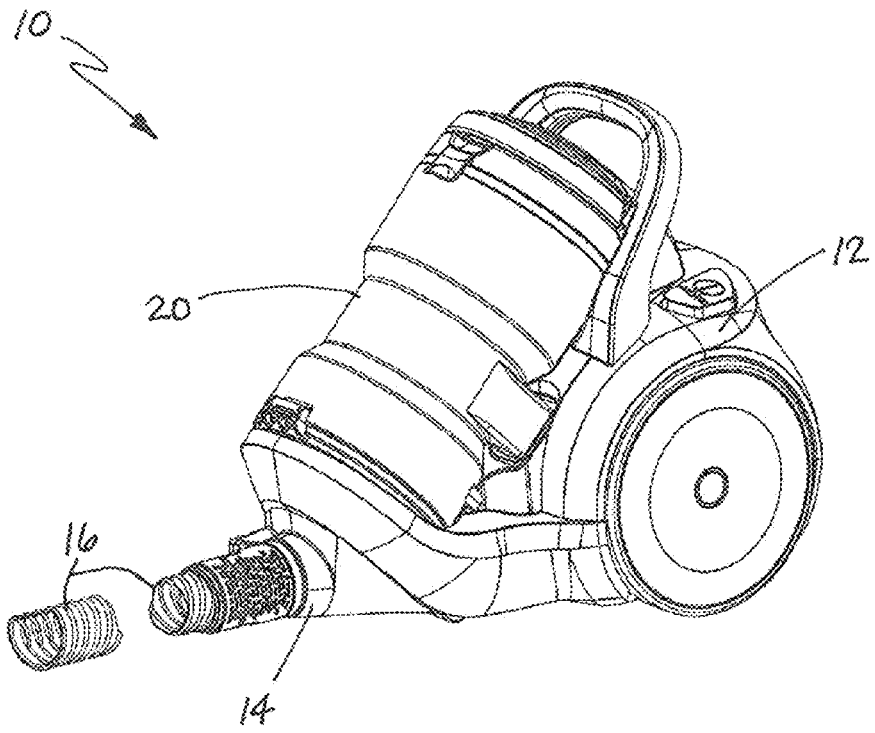
FIG. 1 is a perspective view of the vacuum cleaner.
Figure 3:
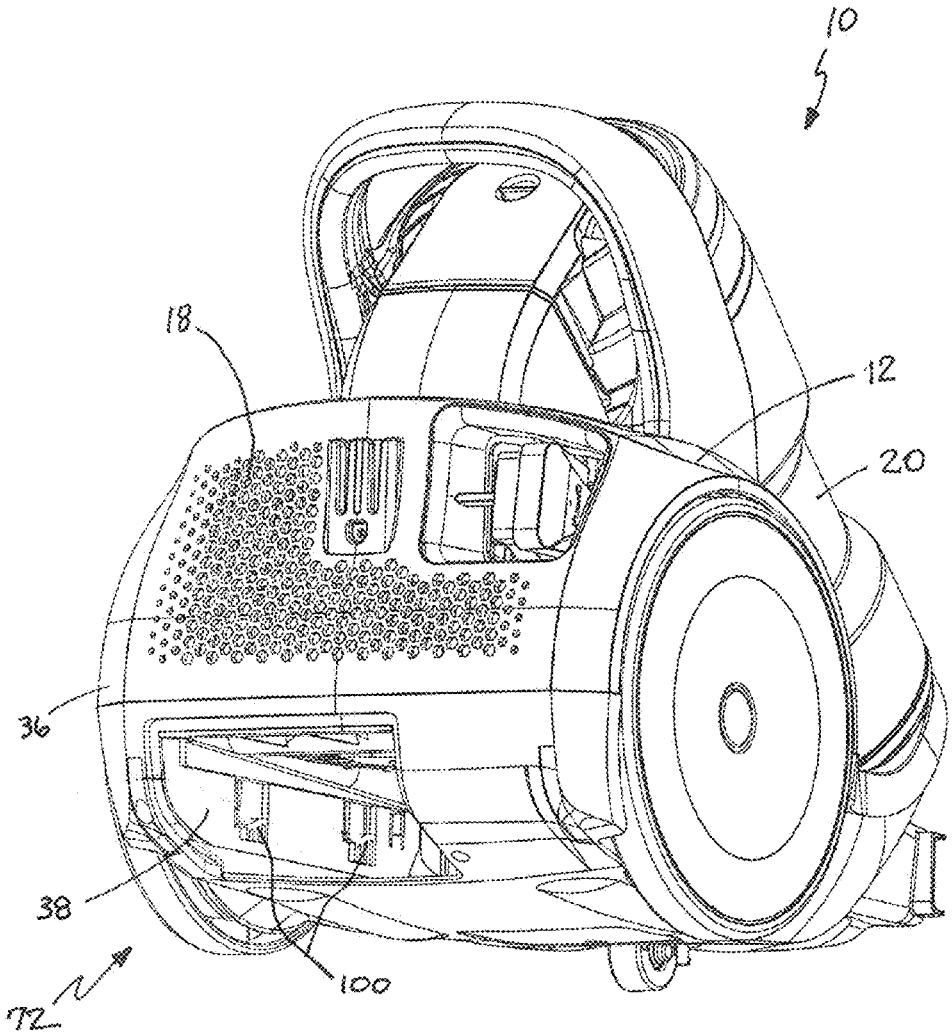
FIG. 3 is a rear perspective view of the vacuum cleaner with the filter drawer removed.
Figure 4:
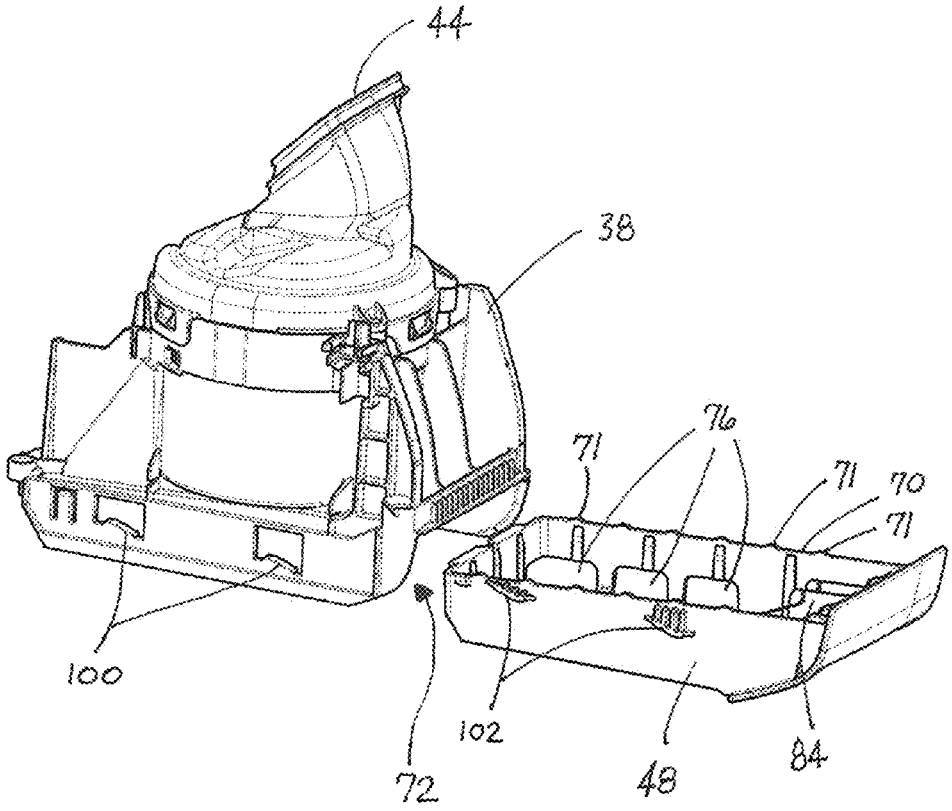
FIG. 4 is a detailed perspective view illustrating the motor assembly housing of the vacuum cleaner with the drawer withdrawn from the motor assembly housing.

Reference is made to FIGS. 1 and 3 generally illustrating the vacuum cleaner 10. The vacuum cleaner 10 includes a body 12 including a suction inlet 14 connected to a flexible hose 16 and an exhaust outlet 18. As is known in the art, the flexible hose may be connected to a wand, a power nozzle assembly or other cleaning tool (not shown).

Figure 2:
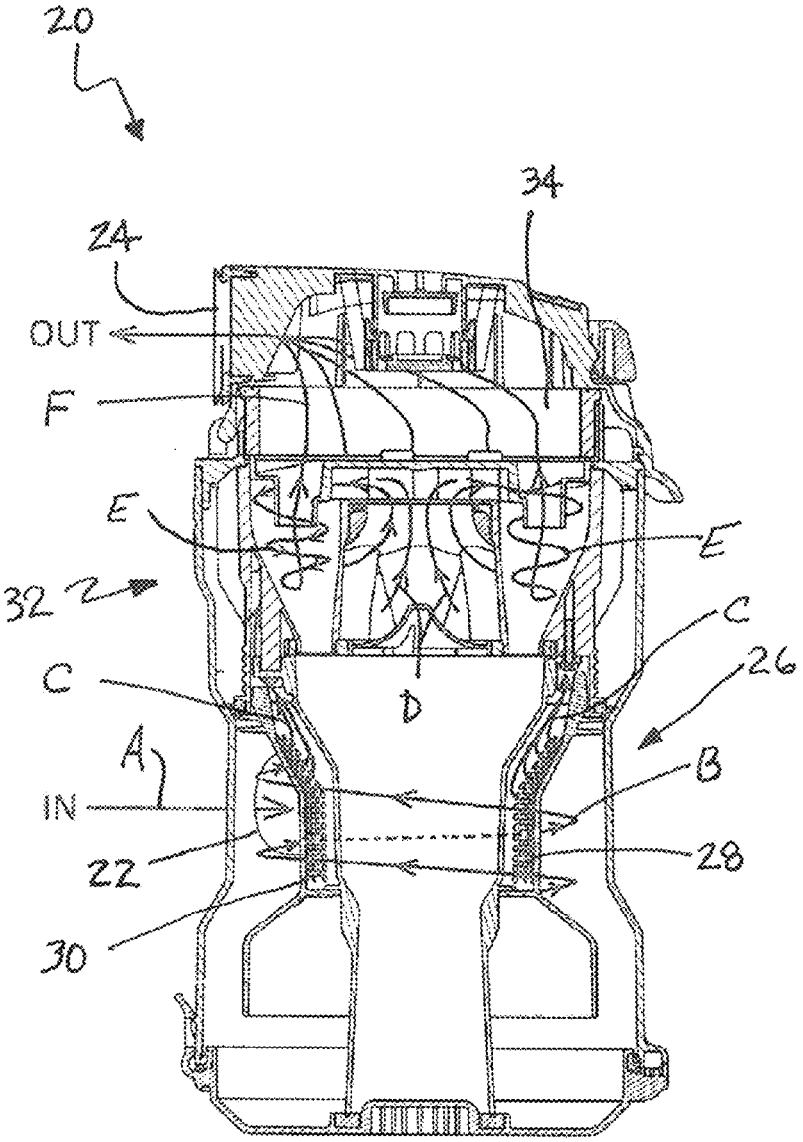
FIG. 2 is a cross-sectional view of the dirt cup assembly of the vacuum cleaner with action arrows illustrating air through the dirt cup.

A dirt collection vessel 20 is carried on the body 12. As best illustrated in FIG. 2, the dirt collection vessel includes an airstream inlet 22 and an airstream outlet 24. The airstream passes through the inlet 22 (note action arrow A) and flows in cyclonic fashion through the primary cyclone 26 (note action arrows B) where relatively coarse dirt and debris is separated and captured. The airstream then flows through the apertures 28 in the shroud 30 and is drawn up and around the outside of the series of secondary cyclones 32 (note action arrows C and D). The airstream then passes through the secondary cyclones 32 which remove the relatively fine dirt and debris before passing from the secondary cyclones through the exhaust manifold 34 and the airstream outlet 24 (see action arrows E and F).

As should be appreciated from reviewing FIGS. 1, 3, 4, 9 and 10, the body 12 includes an outer housing 36 and a suction generator housing 38. The suction generator housing 38 forms a suction generator compartment 40 that receives and holds the suction generator 42. As shown the suction generator housing 38 also includes a suction generator compartment inlet 44 and a suction generator compartment outlet or airstream port 46. A filter drawer or tray 48 is received in a filter drawer receiving opening 72 of the suction generator housing 38. As will be described in greater detail below, a final filter 50 and a sound reducing element 52 are both received in the filter drawer 48.

During vacuum cleaner operation, the suction generator 42 draws an airstream entrained with dirt and debris through the flexible hose 16 into the suction inlet 14. That airstream then travels through the airstream inlet 22 of the dirt collection vessel 20. Relatively large particles of dirt and debris are separated from the airstream and collected in the primary cyclone 26 while relatively fine particles of dirt and debris are separated from the airstream by the secondary cyclones 32. These fine particles pass through the particle discharge ports 47 at the bottom of the secondary cyclones and are collected in the compartment 49 (see also FIG. 2). The airstream then passes through the exhaust manifold 34 and the airstream outlet 24 of the dirt collection vessel 20.

Figure 8:
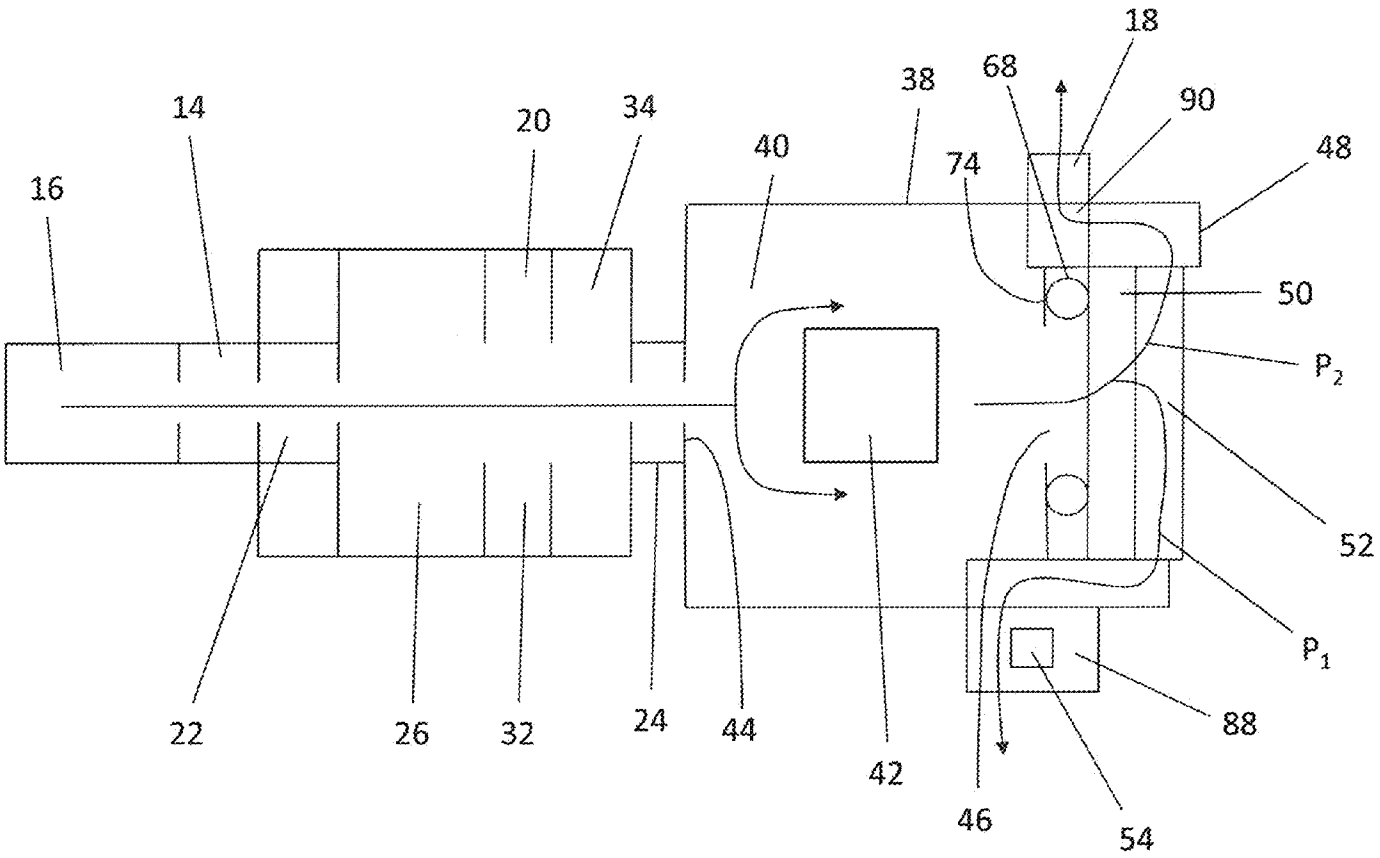
FIG. 8 is a schematical illustration of how the air is directed through the vacuum cleaner.
Figure 9:
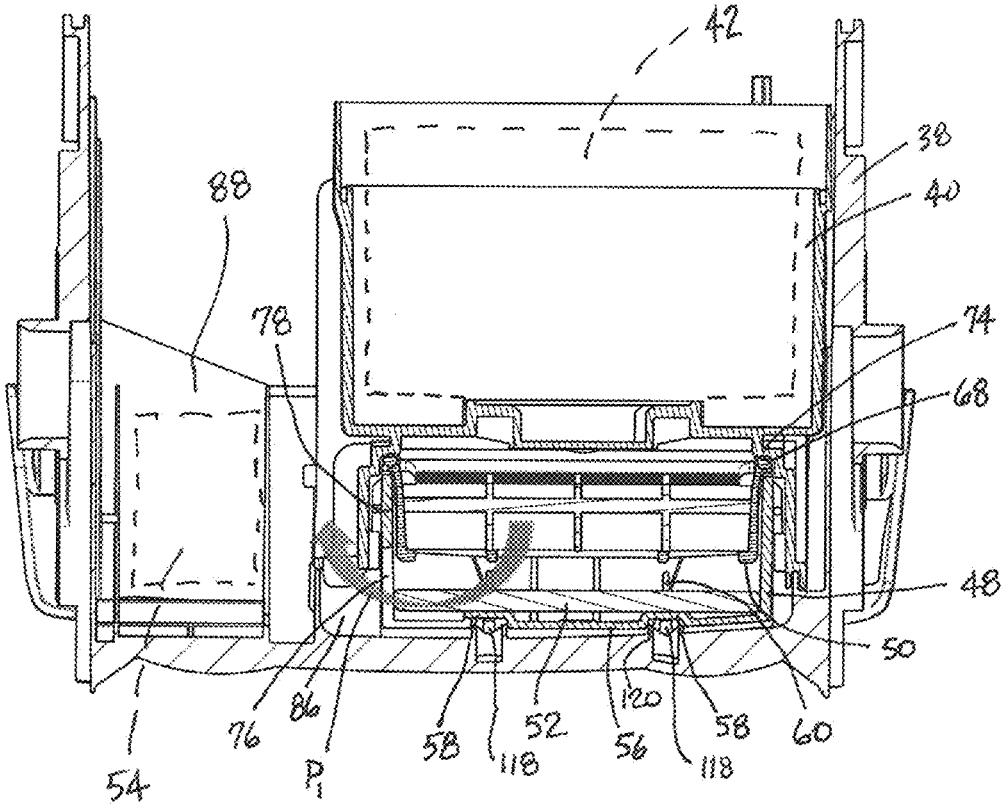
FIG. 9 is a detailed transverse cross-sectional view showing the filter drawer in the fully closed position in the upper and lower sections of the suction generator housing.
Figure 10:
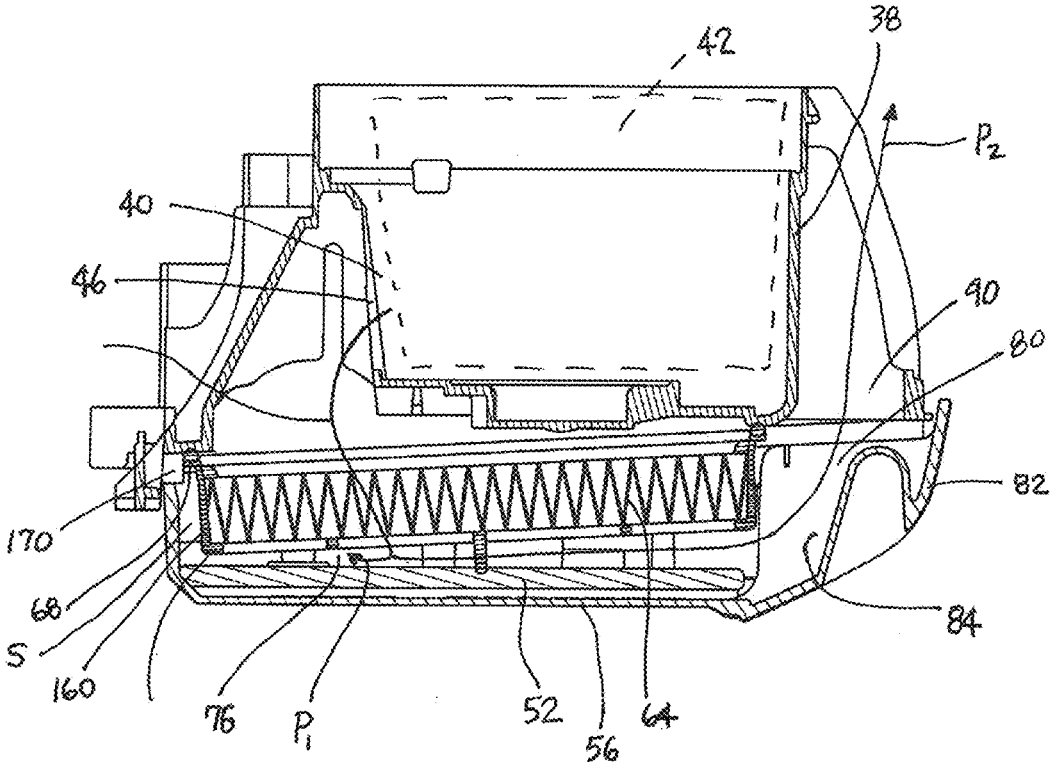
FIG. 10 is a detailed longitudinal cross-sectional view showing the filter drawer in the fully closed position in the upper section of the suction generator housing.

Next the airstream passes through the suction generator compartment inlet 44. The airstream then passes over and cools the motor of the suction generator 42 before being directed through the suction generator outlet or airstream port 46 into the filter drawer 48. The airstream then passes through the final filter 50 which removes any remaining fine particulates therein and then passes through the sound reducing element 52. As will be described in greater detail below, a first portion of the airstream is then directed to a component 54 such as a power control board or cord reel to provide cooling of the component. A second portion of the airstream is directed to the exhaust outlet 18 where it is expelled from the vacuum cleaner 10 back into the environment. FIG. 8 schematically illustrates the airstream flow through the vacuum cleaner 10. FIGS. 8, 9 and 10 show how the airstream is divided in the filter drawer 48 and a first portion $P_1$ is routed to cool the component 54 while the second portion $P_2$ is routed to the exhaust outlet 18.

Reference is now made to FIGS. 5*a*-5*c*, 9 and 10 showing details of the filter drawer 48. As illustrated, the filter drawer 48 includes a bottom wall 56 including two spaced longitudinal ridges 58. Each ridge 58 includes two projecting fingers 60. The sound reducing element 52 is placed over, pierced by and held in position in the bottom of the drawer 48 by the fingers 60. The sound reducing element 52 may be for example, a thin sheet of material made from foam, fabric or batting.

Figure 5A:
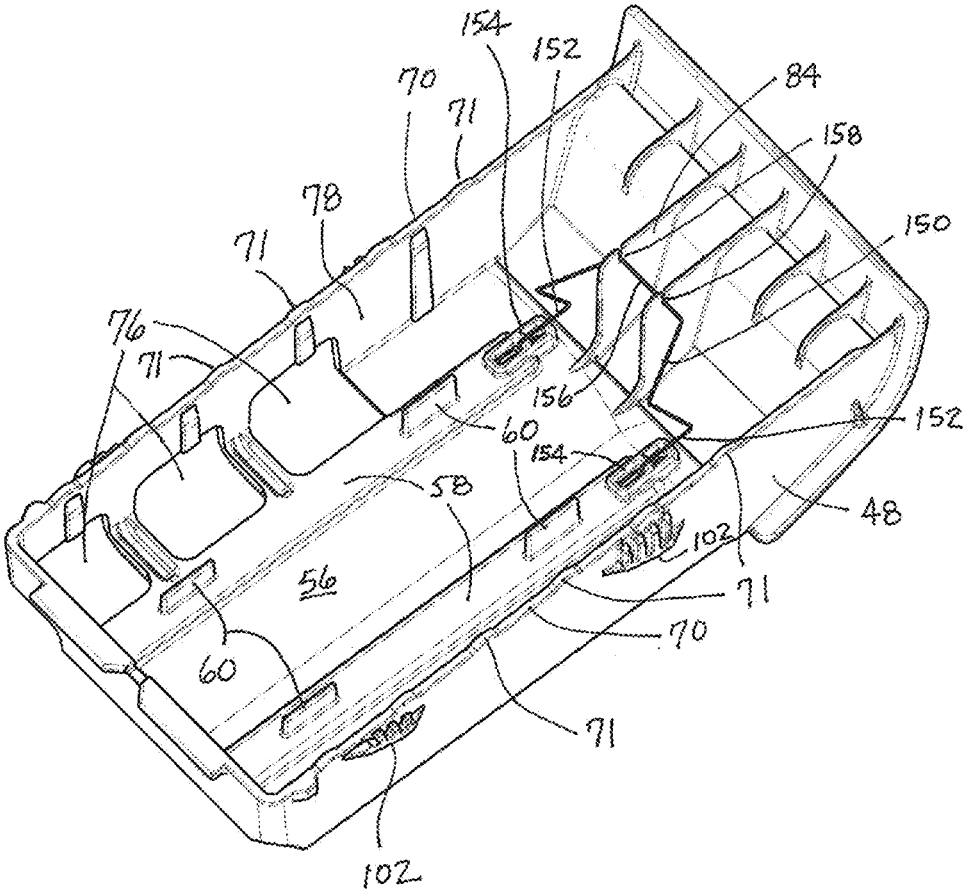
FIG. 5*a* is a perspective view of the interior of the filter drawer with the filter removed illustrating the spring that biases the filter into a home position in the filter drawer.
Figures 5B, 5C:
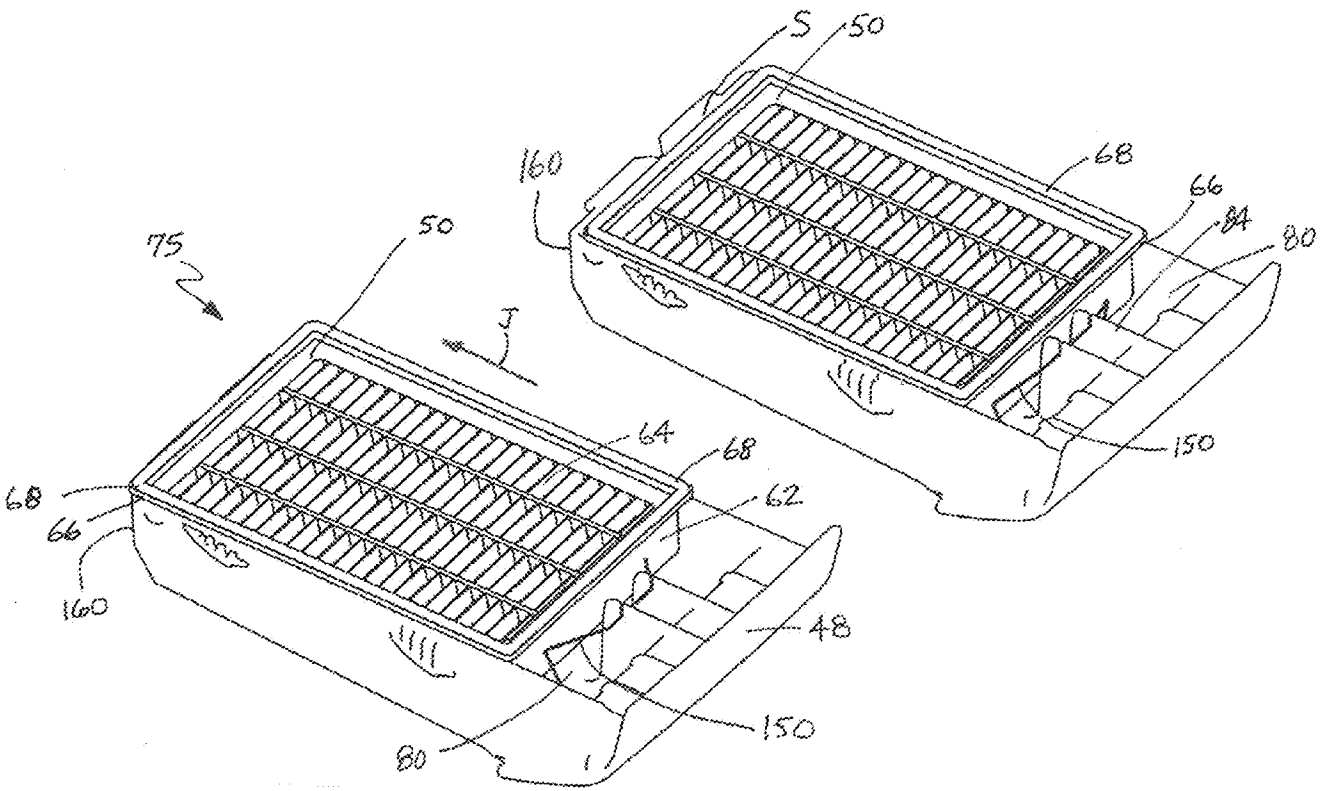
FIG. 5*b* is a perspective view of the interior of the filter drawer illustrating the spring biasing the filter into the home position at the forward end of the drawer.
FIG. 5*c* is a perspective view of the interior of the filter drawer illustrating the filter in the operating position within the filter drawer.
Figure 7:
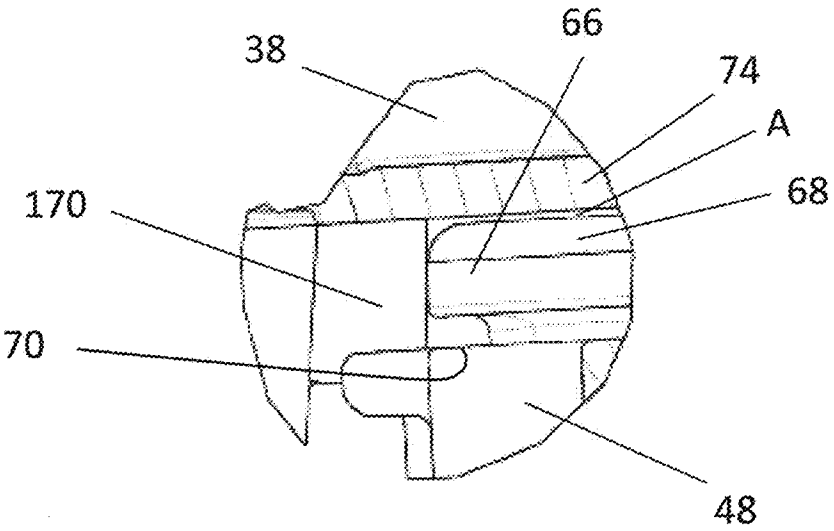
FIG. 7 is a detailed cross-sectional view at the point of contact of the lip of the filter with the stop on the suction generator compartment housing.

As best illustrated in FIGS. 5*b*, 5*c* and 10, the filter 50 may take the form of a cartridge comprising a rectangular frame 62 surrounding and supporting a corrugated filtering media element 64. The filter frame 62 includes a projecting lip 66. A seal 68 is secured to the lip 66. When the final filter 50 is positioned in the drawer 48, the lip engages the upper edge 70 of the drawer so that the filter is supported over the sound reducing element 52. As should be appreciated, the lip 66 is exposed above the top edge 70 of the drawer 48 (see also FIG. 7). Raised bumps 71 spaced along the edge 70 engage the lip 66 and reduce friction between the filter 50 and the drawer 48 so as to insure the filter will move smoothly and freely between the home and operating positions during opening and closing of the drawer in the manner described below.

When the drawer 48 is fully closed, the seal 68 on the filter 50 contracts and seals against the margin 74 of the suction generator housing 38 adjacent to and surrounding the exhaust port 46. This sealing ensures that the airstream is properly directed from the suction generator compartment 40 through the filter 50 and filter drawer 48 and out of the vacuum cleaner 10 so as to provide maximum filtering and operating efficiency.

More particularly, as best illustrated in FIGS. 5*a*-5*c*, 9 and 10, the filter drawer 48 includes an open top cavity that receives the sound reducing element 52 and filter cartridge 50. The filter drawer 48 also includes a first outlet 76 that extends partially in one sidewall 78 and partially in the bottom wall 56 of the drawer. In addition, the filter drawer 48 also includes a second outlet 80 which is positioned between the filter 50 and the handle 82 of the drawer. A series of air guide ribs 84 project upwardly from the bottom wall 56 of the drawer in the second outlet 80 between the handle 82 and filter 50. During operation, the airstream passes in a first direction through the suction generator exhaust port 46 and then directly through the filter media 64 and sound reducing element 52. As the airstream passes through the sound reducing element 52 a first portion of the airstream is drawn in a second direction through the first outlet 76. The second direction is oriented about 90° from the first direction (note action arrow). As illustrated in FIG. 9, the portion $P_1$ of the airstream passing through the first outlet 76 passes through an air vent 86 in the suction generator housing 38 into a secondary compartment 88 which holds the component 54 which may, for example, be a power controlled board, and/or cord reel. The airstream passes over the component 54 so as to provide cooling before being exhausted from the secondary compartment into the environment.

As further illustrated in FIG. 10, a second portion $P_2$ of the airstream passes through the second outlet 80 in a third direction oriented about 180° from the first direction (note action arrow). This second portion $P_2$ of the airstream is guided by the ribs 84 in the second outlet 80 through the exhaust vent 90 formed in the suction generator housing 38. The exhaust vent 90 directs the air through the exhaust outlet 18 provided in the outer housing 36 of the body 12.

As further illustrated in FIG. 5*a*, the drawer 48 includes a filter biasing element 150 in the form of a resilient spring. The spring 150 includes two end legs 152 received in cooperating mounts 154 on the bottom wall 56 of the drawer 48 and a center mounting section 156 received and held in two notches 158 in the air guide ribs 84.

FIG. 5*b* illustrates the filter 50 received in the drawer 48 and biased by the spring 150 into the home position. More specifically, the spring 150 engages the rear wall of the filter frame 62 and biases the filter 50 forward (note action arrow J) against the front wall 160 of the drawer 48 with the lip 66 exposed above the top edge 70 of the front wall.

FIG. 5*c* illustrates the filter 50 in the drawer 48 in the operating position: that is with the filter displaced rearwardly in the drawer so that a space S exists between the front wall 60 of the drawer and the filter (see also FIG. 10). How the filter 50 is displaced in the drawer 48 between the home and operating positions is described below.

Figure 6A:
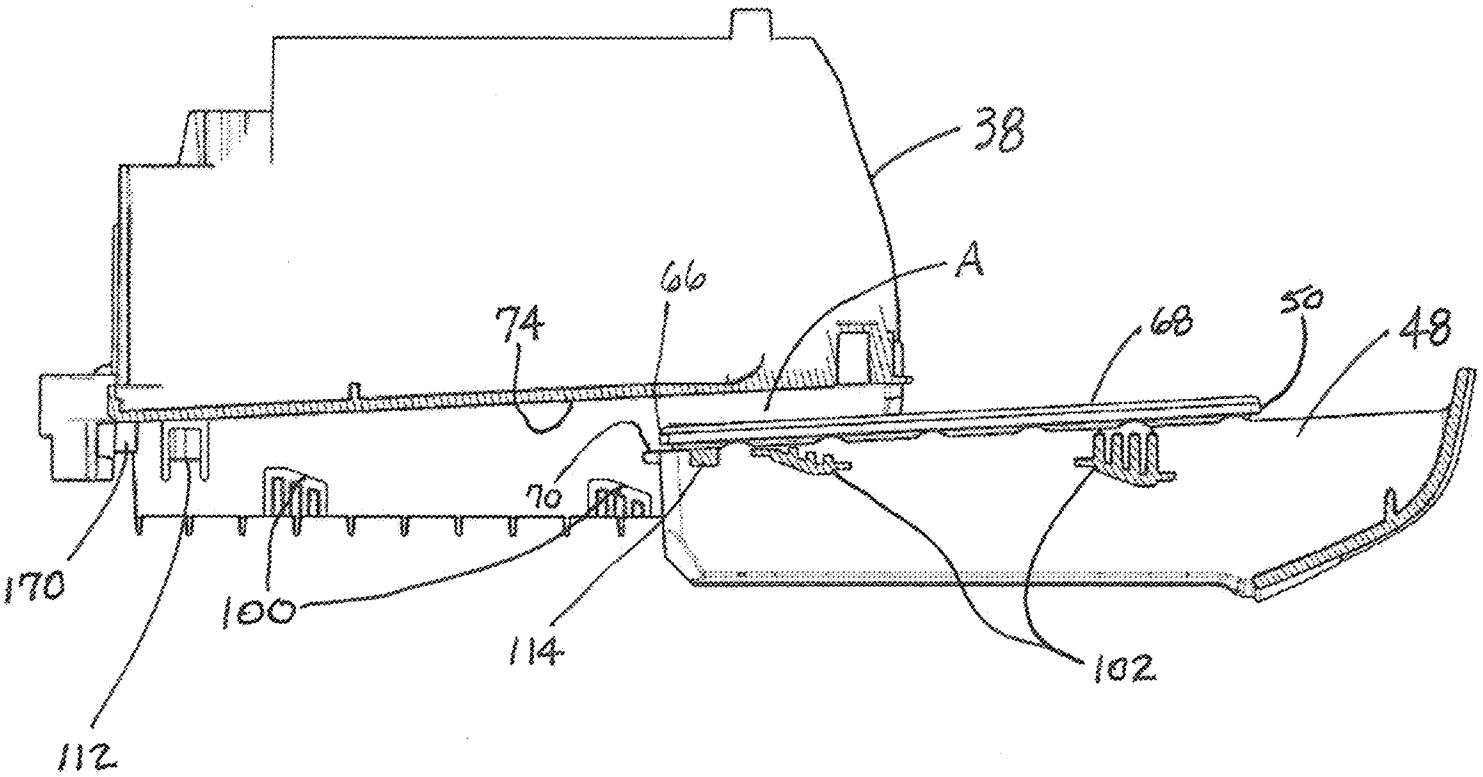
FIG. 6*a* is a longitudinal cross-sectional view through the cooperating cams at one side of the drawer with the drawer in an opened position.
Figure 6B:
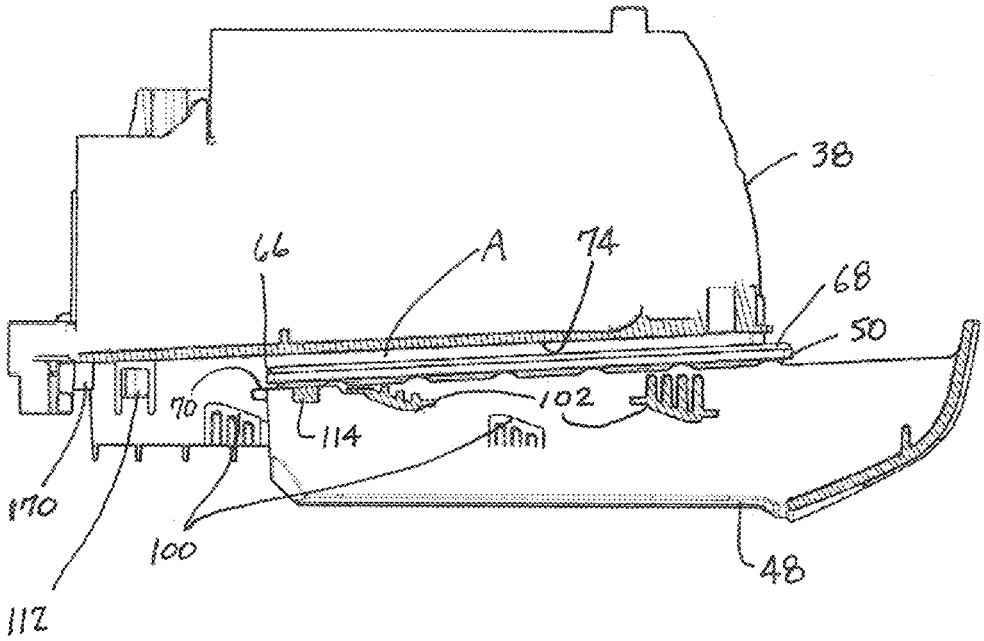
FIG. 6*b* is a view similar to FIG. 6*a* but with the drawer partially closed in a position along the first portion of its travel path.

FIGS. 6*a*-6*e* illustrate the travel path over which the drawer 48 is moved. Proper movement of the drawer 48 within the drawer receiving opening 72 of the suction generator housing 38 is insured by a cooperating cam arrangement generally designated by reference numeral 165. The cam arrangement 165 includes a first set of cams 100, carried on the body 12 and more specifically the suction generator housing 38, and a second set of cams 102 provided on opposing sidewalls of the drawer 48. More specifically, one cam 102 is provided on each side of the drawer adjacent the front of the drawer and one cam 112 is provided on each side of the drawer adjacent the middle of the drawer. Four cooperating cams 100 are positioned on the body 12/housing 38 to engage these cams 102. As illustrated in FIGS. 6*a* and 6*b*, the cams 102 in the front group are vertically offset from those in the middle group so that clearance exists for the cams 102 at the front of the drawer to move past the cams 100 positioned to engage the cams 102 in the middle of the drawer as one slides the drawer closed.

Figure 6C:
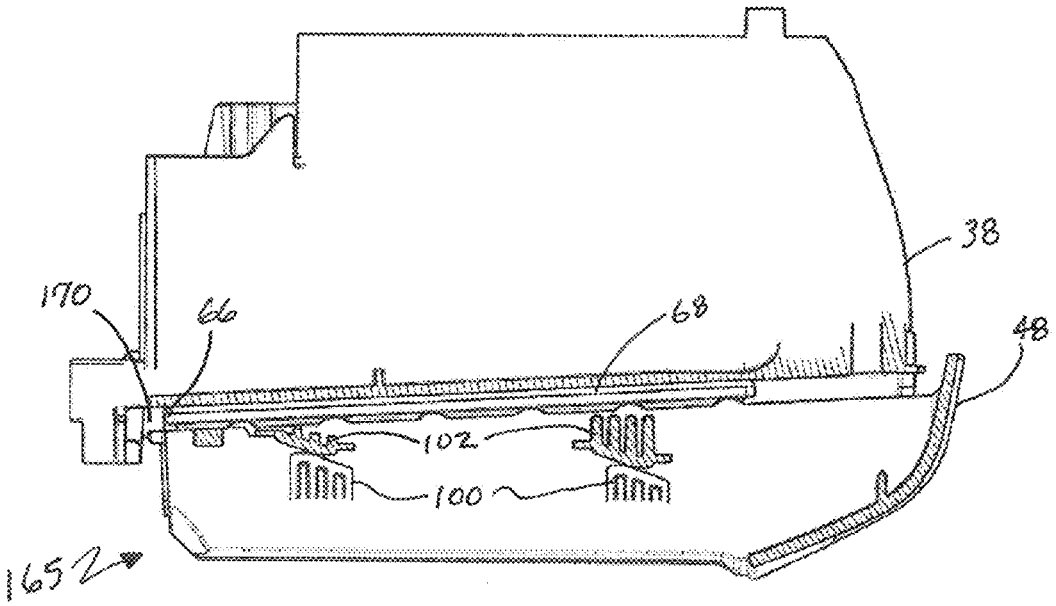
FIG. 6*c* is a view similar to FIGS. 6*a* and 6*b* but illustrating the drawer at the point where the filter stop first contacts the filter with the cam sets partially engaged the filter aligned with the filter seat and a gap maintained between the filter seal and the filter seat.

As illustrated in FIG. 6*a*, when the drawer 48 is in the fully open position, the cams 100, 102 are not engaged and a small space or gap A is maintained between the seal 68 on the filter 50 and the filter seat or margin 74 of the suction generator housing 38 surrounding the suction generator exhaust port 46. FIG. 6*b* illustrates the drawer 48 in a partially closed position along a first portion of the travel path. Note the space or gap A is still maintained. FIG. 6*c* illustrated the filter drawer 48 at the point when a filter stop 170 on the body 12 or suction generator housing 38 first contacts the lip 66 of the filter 50 projecting above the top edge 70 of the drawer. At this point, the filter 50 is aligned with the filter seat 74. Further, the cooperating cam sets 100, 102 are engaged and the drawer 48 and filter 50 is being displaced toward the filter seat 74 on the housing 38. However, a small space A is still maintained between the filter seal 68 and the filter seat 74 (see also FIG. 7). Thus, the space or gap A is maintained throughout the first portion of the travel path followed by the drawer 48.

As one continues to close the drawer 48, the engagement of the cam sets 100, 102 functions to raise the drawer 48 toward the filter seat 74 until the seal 68 on the filter 50 completely engages and seals against the filter seat. As this occurs, the engagement of the stop 170 with the lip 66 of the filter 50 forces the filter to be displaced in the drawer 48 from the home position to the operating position (see also FIGS. 5*b* and 5*c*). In this way, the filter 50 is maintained in absolute alignment with the airstream port 46 as the seal 68 is brought into engagement with the filter seat 74. Thus, while the drawer 48 is moved in a first, lateral direction L parallel to the face of the filter seat 74, the filter 50 is moved in a second direction, approximately 90° removed from the first direction, into sealing engagement (note action arrow M and also see FIG. 6*d*) over a second portion of the travel path followed by the drawer.

It should be appreciated the gap or space A maintained between the seal 68 and the filter seat 74 during the closing of the drawer along the first portion of the travel path provides the necessary clearance to allow smooth operation. In addition, the maintaining of the filter 50 in alignment with the airstream port 46 as the seal 68 is brought into engagement with the filter seat or margin 74 during the second portion of the travel path prevents any possibility of seal distortion to provide the best possible sealing action and the highest operating efficiency. Further, by eliminating lateral movement of the seal 68 across the filter seat 74 when the seal is in engagement with this seat, unnecessary seal wear is eliminated.

Cam latches, generally designated by reference numeral 110, secure the drawer 48 in the closed position. The cam latches 110 include a first cam element 112 carried on the suction generator housing 38 and a second, cooperating cam element 114 carried on the drawer. In the illustrated embodiment one cam latch 110 is provided in each opposing sidewall of the drawer 48 adjacent the front end opposite the handle 82. Guide ribs 118 projecting upwardly from the bottom wall of the suction generator housing 38 are received in cooperating channels 120 formed in the bottom wall of the drawer 48 so as to ensure that the drawer is aligned at all times in the drawer receiving opening 72 and that the cams 100, 102 and cam latches 110 engage and function properly.

Numerous benefits result from the design of the drawer 48. The cams 100, 102, the filter stop 170 and filter biasing spring and cam latches 110 function together to ensure that the filter 50 in the drawer properly seats and seals around the suction generator exhaust port. This ensures the complete integrity of the airflow path. The drawer 48 then functions to split the airstream through the two outlets 76, 80 so as to provide the proper cooling for the downstream component 54 while the sound reducing element 52 minimizes exhaust noise for the portion of the airstream exiting through the exhaust outlet 18. Advantageously the drawer 48 provides these functions in a relatively small space while providing a convenient means to access the filter for cleaning or replacement.

The foregoing description of the preferred embodiment of the vacuum cleaner 10 has been presented for purposes of illustration and description. It is not intended to be exhaustive or to limit the vacuum cleaner to the precise form disclosed. Obvious modifications or variations are possible in light of the above teachings. For example, an upright vacuum cleaner may be equipped with a drawer 48 that functions in the manner described. Further, while the seal 68 is provided on the filter 50 in the illustrated embodiment, it should be appreciated that the seal could be provided on the housing 38 around the port 46. The embodiment was chosen and described to enable one of ordinary skill in the art to utilize the vacuum cleaner in various embodiments and various modifications and suited to particularly use contemplates. The drawings and preferred embodiments do not and are not intended to limit the intended to limit the ordinary meaning of the claims and their fair and broad interpretation in any way.

What is claimed:

1. A floor cleaning apparatus comprising:

a body including a suction inlet and an exhaust outlet;

a dirt collection vessel carried on the body;

a suction generator carried on the body, said suction generator moving an airstream through said suction inlet, said dirt collection vessel and said exhaust outlet;

a filter drawer carried on said body;

a filter carried in said filter drawer, said filter being displaceable between a home position and an operating position in said filter drawer;

an airstream port on said body;

a filter stop on said body displacing said filter from said home position to said operating position in said filter drawer and thereby aligning said filter with said airstream port as said filter drawer is moved from a fully opened position toward a fully closed position; and a cam arrangement to positively displace said filter against said airstream port when said filter drawer is fully closed.

2. The apparatus of claim 1 further including a filter biasing element that biases said filter into a home position within said filter drawer.

3. The apparatus of claim 2, wherein said biasing element is a spring.

4. The apparatus of claim 2 wherein said cam arrangement comprises a first set of cams carried on said body and a cooperating second set of cams carried on said filter drawer.

5. The apparatus of claim 2 wherein said filter drawer moves in a travel path from said fully opened position to said fully closed position.

6. The apparatus of claim 5, wherein said filter is moved into alignment with said airstream port on said body as said filter drawer is moved along a first portion of said travel path until said filter contacts said filter stop.

7. The apparatus of claim 6, further including a seal around said airstream port that seals between said body and said filter when said drawer is in said fully closed position.

8. The apparatus of claim 7 wherein said seal is provided on said filter and a gap is maintained between said seal and said body as said filter drawer is moved along said first portion of said travel path.

9. The apparatus of claim 8, wherein said filter is moved toward said airstream port until said seal engages against said body around said airstream port as said filter drawer is moved along a second portion of said travel path from a point when said filter first engages said filter stop until said filter drawer is in said fully closed position.

10. The apparatus of claim 9, wherein said filter is displaced against said biasing element from said home position to an operating position in said filter drawer as said filter drawer is moved along said second portion of said travel path.

11. The apparatus of claim 10, wherein said filter includes a lip and said lip is exposed above a top edge of said filter drawer when said filter is received and held in said filter drawer.

12. The apparatus of claim 11, wherein said filter stop engages said lip of said filter extending above a top front edge of said filter drawer.

13. The apparatus of claim 10, wherein said body includes a suction generator housing forming a suction generator compartment that receives and holds a suction generator, said suction generator housing including a suction generator compartment inlet and a said airstream port.

14. The apparatus of claim 13, wherein a filter seat is defined by a margin of said suction generator housing surrounding said airstream port.

15. The apparatus of claim 14 further including a cam latch that secures said drawer in said closed position.

16. The apparatus of claim 15, wherein said cam latch includes a first cam element carried on said body and a second cam element carried on said filter drawer.

17. The apparatus of claim 14, wherein a wall of said motor housing includes a drawer guide and said drawer includes a drawer guide channel receiving said drawer guide.

18. The apparatus of claim 3, wherein said spring provides a biasing force of between about 3 and about 7 Newtons.

19. A method of sealing a filter in a filter drawer around an airstream port in a housing that receives said filter drawer, said method comprising:

moving said filter drawer along a travel path between a fully opened position and a fully closed position;

aligning said filter with said airstream port as said filter drawer is moved along a first portion of said travel path; and displacing said filter drawer and filter toward said housing until a seal engages and seals around said airstream port between said housing and said filter including displacing said filter into an operating position in said filter drawer as said filter drawer is moved along a second portion of said travel path.

20. The method if claim 19 including biasing said filter into a home position in said filter drawer as said filter drawer is moved along said first portion of said travel path.

* * * * *